US010208485B2

(12) United States Patent
Serino et al.

(10) Patent No.: US 10,208,485 B2
(45) Date of Patent: Feb. 19, 2019

(54) BUILDING MATERIAL CLADDING COMPONENTS AND METHODS

(71) Applicant: Dryvit Systems, Inc., West Warwick, RI (US)

(72) Inventors: Roland Serino, East Greenwich, RI (US); William Preston, Johnston, RI (US); Robert Lombardi, W. Greenwich, RI (US)

(73) Assignee: DRYVIT SYSTEMS, INC., West Warkwick, RI (US)

( * ) Notice: Subject to any disclaimer, the term of this patent is extended or adjusted under 35 U.S.C. 154(b) by 0 days.

(21) Appl. No.: 15/843,902

(22) Filed: Dec. 15, 2017

(65) Prior Publication Data

US 2018/0171641 A1 Jun. 21, 2018

Related U.S. Application Data

(60) Provisional application No. 62/434,691, filed on Dec. 15, 2016.

(51) Int. Cl.
*E04F 13/06* (2006.01)
*E04F 13/08* (2006.01)
(Continued)

(52) U.S. Cl.
CPC ..... *E04F 13/0862* (2013.01); *E04C 2/041* (2013.01); *E04F 13/073* (2013.01);
(Continued)

(58) Field of Classification Search
CPC ... E04F 13/0864; E04F 19/02; E04F 13/0862; E04F 13/0873; E04F 13/185; E04F 19/0436; E04F 13/06
See application file for complete search history.

(56) References Cited

U.S. PATENT DOCUMENTS 3,046,700 A * 7/1962 Davenport ..... E04F 13/0864 52/409
4,069,075 A 1/1978 Billing
(Continued)

FOREIGN PATENT DOCUMENTS

FR 2633563 A1 1/1990
GB 1127311 A 9/1968
GB 2457293 A 8/2009

OTHER PUBLICATIONS

Website printout, Tianjin Jhongjie, "neu polyurethane foam brick wall panel", at least as early as Aug. 31, 2015.
(Continued)

*Primary Examiner* — Brian E Glessner
*Assistant Examiner* — Daniel J Kenny
(74) *Attorney, Agent, or Firm* — Calfee, Halter & Griswold LLP

(57) ABSTRACT

A starter board for a wall cladding system includes a core member and a laminate. The core member defines a board profile portion including parallel, planar base and outer surfaces defining a uniform thickness, the base surface extending from a first lateral surface to a second lateral surface, and a supporting flange portion extending outward from the planar outer surface, at the second lateral surface, to an outer surface of the flange portion. The laminate includes a reinforcing mesh and a basecoat layer covering the reinforcing mesh, and covers the second lateral surface of the board profile portion, the inner and outer lateral surfaces of the supporting flange portion, the outer surface of the supporting flange portion, and portions of the base and outer surfaces of the board profile portion proximate the supporting flange portion.

10 Claims, 10 Drawing Sheets

(51) Int. Cl.

| | |
|---|---|
| ***E04C 2/04*** | (2006.01) |
| ***E04F 13/073*** | (2006.01) |
| ***E04F 13/18*** | (2006.01) |
| *E04C 2/00* | (2006.01) |

(52) U.S. Cl.
CPC ..... *E04F 13/0889* (2013.01); *E04F 13/185* (2013.01); *E04C 2002/004* (2013.01)

(56) References Cited

U.S. PATENT DOCUMENTS

| | | | | |
|---|---|---|---|---|
| 4,077,177 | A | 3/1978 | Boothroyd | |
| 4,229,497 | A | 10/1980 | Piazza | |
| 5,367,847 | A | 11/1994 | Hepler | |
| 5,398,473 | A * | 3/1995 | Chan | E04F 13/0812 52/235 |
| 5,819,485 | A * | 10/1998 | Lane | E04F 19/0436 52/287.1 |
| 5,930,964 | A | 8/1999 | Boehning | |
| 5,987,835 | A * | 11/1999 | Santarossa | E04F 13/04 52/309.8 |
| 6,481,170 | B1 | 11/2002 | Savenok et al. | |
| 8,846,153 | B2 * | 9/2014 | Newton | E04F 19/04 156/145 |
| 9,677,270 | B2 | 6/2017 | Serino et al. | |
| 2005/0247022 | A1 | 11/2005 | Poupart | |
| 2005/0257475 | A1 | 11/2005 | Gong et al. | |
| 2006/0185299 | A1 | 8/2006 | Poupart | |
| 2007/0193150 | A1 * | 8/2007 | Carlson | E04F 13/007 52/302.1 |
| 2008/0216430 | A1 | 9/2008 | Gleeson et al. | |
| 2009/0235600 | A1 | 9/2009 | Logan | |
| 2009/0249722 | A1 | 10/2009 | Russell | |
| 2011/0185662 | A1 | 8/2011 | Mollinger et al. | |
| 2013/0111843 | A1 | 5/2013 | Litral | |
| 2014/0087158 | A1 | 3/2014 | Ciuperca | |
| 2015/0218829 | A1 | 8/2015 | Curtis | |
| 2017/0268230 | A1 | 9/2017 | Serino et al. | |

OTHER PUBLICATIONS

StackEZE Brick Products, as least as early as Aug. 31, 2015.
Search Report and Written Opinion for International Application No. PCT/US2016/049618 dated Jan. 12, 2017.
Office Action for U.S. Appl. No. 15/611,040 dated Aug. 2, 2017.

* cited by examiner

BUILDING MATERIAL CLADDING COMPONENTS AND METHODS

CROSS-REFERENCE TO RELATED APPLICATION

This application claims priority from U.S. Provisional Patent Application Ser. No. 62/434,691, filed on Dec. 15, 2016, for BUILDING MATERIAL CLADDING COMPONENTS AND METHODS, the entire disclosure of which is fully incorporated herein by reference.

BACKGROUND

The use of common clay brick as a finish for all types of buildings is very popular and provides unique aesthetics, but such brick finishes are relatively expensive and commonly offer poor insulation. Thin brick cladding, installed over sheathing, concrete, insulation boards, and masonry substrates has been available as an alternative, but such wall cladding systems are often deficient in fire resistant properties and ease of installation.

SUMMARY

The present disclosure is directed to polymer-based building products, particularly polymer-based exterior wall cladding and exterior wall cladding systems, and related methods for preparing the exterior wall cladding and exterior wall cladding systems.

Accordingly, in an exemplary embodiment, a simulated brick includes a polymeric core member, a mesh layer adhered to the core member, a basecoat layer covering an entirety of the mesh layer, and a finish layer covering an entirety of the basecoat layer. The core member, the mesh layer, the basecoat layer, and the finish layer together define a brick profile portion having first and second lateral sides extending to a planar outer surface to define a first thickness, and an offset portion extending from the first lateral side of the brick profile portion to a lateral end surface and having an outer surface defining a second thickness smaller than the first thickness, the brick profile portion and the offset portion together defining a planar rectangular base surface extending from the second lateral side of the brick profile portion to the lateral end surface of the offset portion.

In another exemplary embodiment, a method of manufacturing a simulated brick is contemplated. In an exemplary method, a polymeric core member is formed, the core member including a brick profile portion having first and second lateral sides extending to a planar outer surface to define a first thickness, and an offset portion extending from the first lateral side of the brick profile portion to a lateral end surface and having an outer surface defining a second thickness smaller than the first thickness, the brick profile portion and the offset portion together defining a planar rectangular base surface extending from the second lateral side of the brick profile portion to the lateral end surface of the offset portion. A mesh layer is adhered to the first and second lateral sides and the outer surface of the brick profile portion and to the lateral end surface and the outer surface of the offset portion. A basecoat layer is deposited onto an entirety of the mesh layer. A finish layer is deposited onto an entirety of the basecoat layer.

In another exemplary embodiment, a method of applying simulated bricks to a wall surface is contemplated. In an exemplary method, at least first and second simulated bricks are provided, with each including a brick profile portion having first and second lateral sides extending to a planar outer surface to define a first thickness, and an offset portion extending from the first lateral side of the brick profile portion to a lateral end surface and having an outer surface defining a second thickness smaller than the first thickness, the brick profile portion and the offset portion together defining a planar rectangular base surface extending from the second lateral side of the brick profile portion to the lateral end surface of the offset portion. An adhesive layer is applied to the wall surface. The base surface of the first simulated brick is adhered to the adhesive layer, and the base surface of the second simulated brick is adhered to the adhesive layer such that at least a portion of the lateral end surface of the offset portion of the second simulated brick abuts the second lateral side of the brick profile portion of the first simulated brick. A grout material is applied to the outer surface of the offset portion of the second simulated brick.

In another exemplary embodiment, a wall system includes a wall substrate having a substantially planar exterior surface, and at least first and second simulated bricks. The first and second simulated bricks each include a brick profile portion having first and second lateral sides extending to a planar outer surface to define a first thickness, and an offset portion extending from the first lateral side of the brick profile portion to a lateral end surface and having an outer surface defining a second thickness smaller than the first thickness, the brick profile portion and the offset portion together defining a planar rectangular base surface extending from the second lateral side of the brick profile portion to the lateral end surface of the offset portion. The planar rectangular base surfaces of the first and second simulated bricks are adhered to the exterior surface of the wall substrate such that at least a portion of the lateral end surface of the offset portion of the second simulated brick abuts the second lateral side of the brick profile portion of the first simulated brick. A grout material is adhered to the outer surface of the offset portion of the second simulated brick.

In another exemplary embodiment, a simulated brick includes a brick profile portion having first and second lateral sides extending between first and second longitudinal ends to a planar outer surface to define a first thickness, and a separate offset component attached to the first lateral side of the brick profile portion and having an outer surface defining a second thickness smaller than the first thickness. The brick profile portion and the offset component together define a planar rectangular base surface extending from the second lateral side of the brick profile portion to the lateral end surface of the offset portion.

In another exemplary embodiment, a simulated brick includes a brick profile portion having first and second lateral sides extending between first and second longitudinal ends to a planar outer surface to define a first thickness, and a separate offset component attached to the first longitudinal end of the brick profile portion and having an outer surface defining a second thickness smaller than the first thickness. The brick profile portion and the offset component together define a planar rectangular base surface extending from the second lateral side of the brick profile portion to the lateral end surface of the offset portion.

In another exemplary embodiment, a simulated brick includes a brick profile portion having first and second lateral sides extending between first and second longitudinal ends to a planar outer surface to define a first thickness, a first offset portion extending from the first lateral side of the brick profile portion and having an outer surface defining a second thickness smaller than the first thickness, and a second offset portion extending from the first longitudinal end of the brick profile portion and having an outer surface defining a third thickness smaller than the first thickness. The brick profile portion and the first and second offset portions together define a planar base surface.

In another exemplary embodiment, a wall cladding panel includes a plurality of brick profile portions each having first and second lateral sides extending between first and second longitudinal ends to a planar outer surface to define a first thickness, at least one intermediate offset portion between adjacent ones of the plurality of brick profile portions and having an outer surface defining a second thickness smaller than the first thickness, and at least one outer offset portion extending from an endmost one of the plurality of brick profile portions and having an outer surface defining a third thickness smaller than the first thickness. The brick profile portion, the at least one intermediate offset portion, and the at least one outer offset portion together define a planar base surface.

In another exemplary embodiment, a starter board for a wall cladding system includes a core member and a laminate. The core member defines a board profile portion including parallel, planar base and outer surfaces defining a uniform thickness, the base surface extending from a first lateral surface to a second lateral surface, and a supporting flange portion extending outward from the planar outer surface, at the second lateral surface, to an outer surface of the flange portion. The laminate includes a reinforcing mesh and a basecoat layer covering the reinforcing mesh. The laminate covers the second lateral surface of the board profile portion, the inner and outer lateral surfaces of the supporting flange portion, the outer surface of the supporting flange portion, and portions of the base and outer surfaces of the board profile portion proximate the supporting flange portion, such that the first lateral surface of the board profile portion and portions of the base and outer surfaces of the board profile portion proximate the first lateral surface are not covered by the laminate.

In another exemplary embodiment, a method of installing a wall cladding system is contemplated. In the exemplary method, a base surface of a starter board is secured to a building substrate, the starter board including a supporting flange extending outward from a lower edge of a board profile portion. One or more insulation boards are secured to the building substrate above the starter board, the one or more insulation boards having an outer surface defining a thickness that substantially matches a thickness of the board profile portion of the starter board. A mesh reinforced basecoat membrane is applied to the outer surfaces of the starter board and the one or more insulation boards, with the basecoat membrane contacting and adhering to a basecoat layer of the starter board. A row of simulated bricks is adhered to the basecoat membrane with a lateral side of the simulated bricks being supported and aligned by the supporting flange.

DETAILED DESCRIPTION

The present disclosure is directed to insulative wall cladding building products, particularly polymer-based simulated bricks, and related methods for preparing and installing the building products. In certain exemplary embodiments, a polymer-based building product includes a polymer core member at least partially covered with a reinforcing mesh material, such as a fiberglass mesh material. The reinforcing mesh material is at least partially coated with or at least partially embedded in a basecoat layer, such as a polymer-modified cementitious basecoat, and the basecoat layer is at least partially covered by an outermost finish layer, to provide a desired color and texture for the wall cladding. In one such exemplary embodiment, the textured finish layer gives the exterior wall cladding the appearance of a conventional clay brick.

Other exemplary simulated brick wall cladding components and systems are described in U.S. patent application Ser. No. 15/351,566, entitled "EXTERIOR POLYMER-BASED BRICK BUILDING MATERIAL" (the "'566 Application"), the entire disclosure of which is incorporated herein in its entirety, and is at least in part reproduced herein. Any one or more of the embodiments described herein may, but need not, utilize any one or more of the features and configurations (e.g., dimensions, materials, material properties, fabrication methods, installation methods, etc.) described in the '566 Application.

Figure 1:
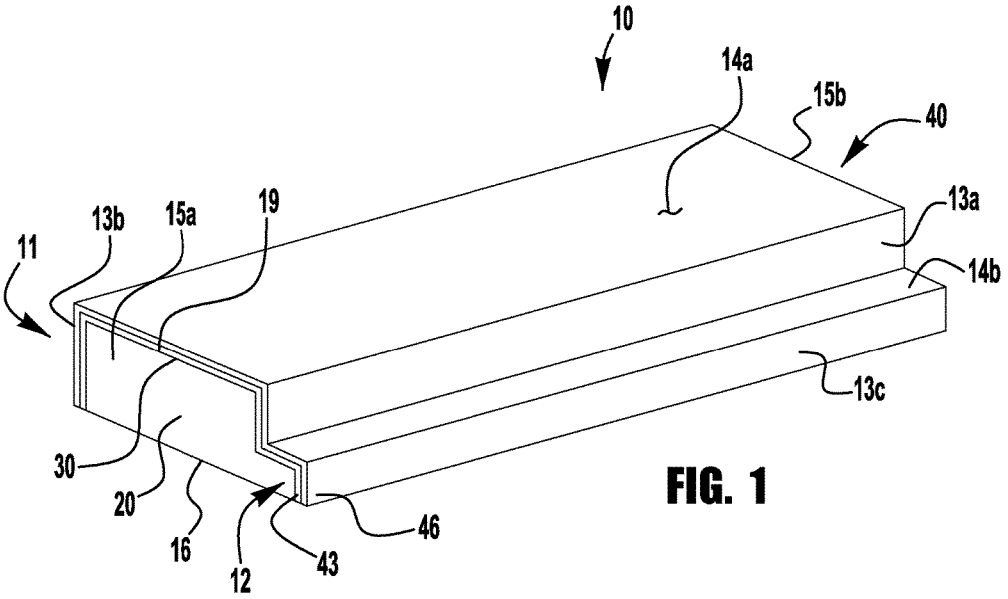
FIG. 1 shows an upper perspective view of an exemplary simulated brick wall cladding component according to the present disclosure.
Figure 2:
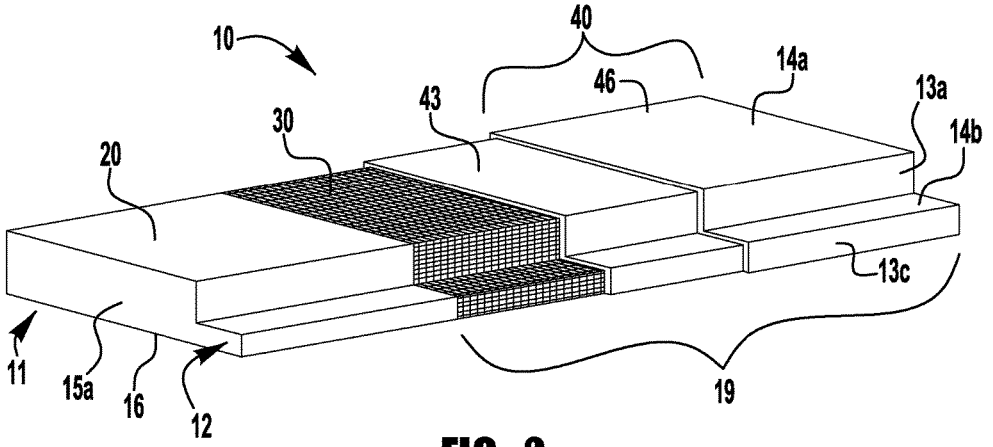
FIG. 2 shows an upper perspective cut-away cross-sectional view of the simulated brick wall cladding component of FIG. 1.

FIGS. 1 and 2 illustrate an exemplary simulated brick 10 including a polymeric core member 20, a mesh layer 30 adhered to the core member 20, and a coating 40 covering the mesh layer 30. In some embodiments, the coating may include a single layer providing protection for the core member, a barrier to fire propagation, exterior surface durability, and desired exterior aesthetic characteristics (e.g., color, texture). In other embodiments, as shown, the coating 40 may include an inner, basecoat layer 43 directly deposited (e.g., by extrusion coating) onto the mesh layer 30 to cover the mesh layer and to provide strength and fire barrier properties, and a finish layer 46 deposited (e.g., by extrusion coating) onto the basecoat layer 43 to provide desired surface durability and exterior aesthetic properties. In still other embodiments, additional coating layers may be provided.

The mesh layer 30, basecoat layer 43, and the finish layer 46 may together form a relatively thin (e.g., about ⅛ inch thick) laminate 19 defining the lateral (or side) surfaces 13*a*, 13*b*, 13*c* and outer (or top) surfaces 14*a*, 14*b* of the simulated brick 10. As shown, the end surfaces 15*a*, 15*b* of the core member 20 may remain exposed or uncovered by the laminate 19, allowing for production of the simulated bricks by forming an elongated laminated core that is cut into multiple brick-sized wall cladding components. A base (or bottom) surface 16 of the core member 20 may also be exposed or uncovered by the laminate 19, for example, to facilitate adhesion of the simulated brick 10 to a wall surface.

The core member material may be selected to provide desired insulation properties. Exemplary materials include polystyrene foams such as expanded polystyrene ("EPS") or extruded polystyrene ("XPS") or other similar insulation materials, including, for example, polyisocyanurate, polyurethane, and foam glass. In certain embodiments, the core is a polymer material having a density of about 0.5 to about 5 pcf, or about 1 to about 2 pcf, or about 1.5 pcf. In an exemplary embodiment, the core is an XPS having a density of 1.5 pcf. In accordance with certain exemplary embodiments, the core is an XPS meeting ASTM C578. The insulative polymer core member may provide an effective R-value between about 2 and about 8 h·° F.·ft$^2$·in/BTU. In an exemplary embodiment, an XPS core member has an R-value of about 5 h·° F.·ft$^2$·in/BTU.

The mesh layer 30 may include a variety of reinforcing, strengthening, and/or fire resistant mesh materials, such as, for example, a fiberglass or polymer strand material. Non-limiting examples of suitable polymer mesh materials include polyester, polypropylene, aramid, and carbon. The reinforcing mesh may be constructed using an open weave. In certain embodiments, the reinforcing mesh material includes or is coated with an alkali resistant material. In certain embodiments, the mesh layer 30 is provided with an adhesive on one side so it can be applied directly to the surface of the core member 20 to maintain its position until the basecoat layer 43 is deposited over the mesh layer. The alkali resistance improves compatibility of the reinforcing mesh material with cement-based materials, such as cement-based mortars, grouts, basecoat layer, and the like used in accordance with the present disclosure. In one such exemplary embodiment, the reinforcing mesh material comprises an about 3.6 lbs/yd$^2$ weight, open weave of fiberglass strands including alkali resistant glass and/or glass fibers coated with an alkali resistant material. In certain embodiments, the reinforcing mesh material comprises a fire resistant or non-combustible material, such as certain types of fiberglass and/or certain fiberglass or polymer strands coated with a fire resistant size composition. The fire resistant mesh material may be selected to produce, in combination with the other simulated brick materials, a wall cladding product suitable to meet one or more applicable non-combustible, fire resistant, and/or fire proof standards, including, for example, NFPA 285, NFPA 268, ASTM E84, and ASTM E119. In one such example, the mesh material has a melting point of approximately 2000° F.

The basecoat layer 43 may include any of a variety of suitable materials compatible with, and adherent to, the core 20, mesh 30, and textured finish layer 46, such as, for example, a polymer modified cementitious mortar material. In an exemplary embodiment, the basecoat layer comprises a Type N or S mortar modified with a suitable amount of acrylic polymer to provide improved adhesion, flexibility and workability. One such polymer modified mortar material includes Portland cement, silica sands, styrene acrylic based polymers and other non-combustible fillers. As shown, the basecoat layer 43 may cover an entirety of the mesh layer 30.

The textured finish layer 46 may include any of a variety of suitable materials compatible with, and adherent to, the basecoat layer 43 and mortar/grout material used with the simulated bricks (described below), and that provides the desired durability, texture, and appearance, such as that of a clay brick. Exemplary materials include acrylic, styrene acrylic, veova, or vinyl acrylic acetate. The textured surface layer may be suited to weather a variety of external environmental conditions, such as damaging effects caused by the sun, rain, cold, humidity, etc. As shown, the finish layer 46 may cover an entirety of the basecoat layer 43.

In accordance with certain embodiments, the exterior wall cladding (e.g., simulated bricks) may be applied to any common exterior wall surface, including, plywood, oriented strand board, glass mat gypsum sheathing, cement board sheathing, ICF's, exterior insulation and finish system ("EIFS") basecoat, concrete, and masonry. Typically, square-edged insulation bricks (which are not in accordance with the present disclosure) are applied to an uncoated expanded polystyrene core member that has built-in projecting strips or offsets, thereby allowing the squared-edged brick to maintain its position on the wall without sliding. Square-edged insulation bricks applied to other surfaces require the use of tile spacers or metal pans and clips to allow the bricks to stay in position without sliding and also to keep a consistent grout joint.

According to one aspect of the present application, a simulated brick wall cladding component may be provided with a brick profile portion and at least one offset portion extend from at least one lateral side of the brick profile portion to abut at least a portion of a brick profile portion of an adjacent simulated brick when the simulated bricks are secured to a wall surface. The offset portion may facilitate installation of a multiple row array of the simulated bricks, by providing for consistent, uniform spacing between the brick profile portions of adjacent rows of simulated bricks, preventing misalignment due to slippage without the use of spacer tiles, clips, or metal pans, as commonly used in the installation of conventional "thin brick" wall cladding. Additionally, these offset portions may provide additional insulation for the mortar joint spaces between the simulated bricks.

To form a simulated brick having a lateral offset portion, as shown in FIGS. 1 and 2, the core member 20 may be provided with a brick profile portion 11, generally in the shape of a thin brick (e.g., about 7⅝ inches long, about 2¼ inches wide, and about 1 inch thick, or about 7⅝ inches long, about 2⅝ inches wide, and about 1⅛ inches thick, or about 11⅝ inches long, about 4 inches wide, and about 1⅛ inches thick). The exemplary brick profile portion includes first and second lateral sides 13*a*, 13*b* extending to a planar outer surface to define a uniform thickness, and a thinner lip or offset portion 12 extending laterally from the first lateral side 13*a* of the brick profile portion 11 to a lateral end surface 13*c* of the offset portion. The brick profile portion 11 and the offset portion 12 together define a planar rectangular base surface 16 extending from the second lateral side 13*b* of the brick profile portion to the lateral end surface 13*c* of the offset portion 12. As shown, the first and second lateral sides 13*a*, 13*b*, the lateral end surface 13*c*, and the outer surfaces 14*a*, 14*b* may be defined by the finish layer 46, and the base surface 16 may be defined by the core member 20.

In the exemplary embodiment, the offset portion 12 extends a distance corresponding to a desired width of a mortar joint to be applied between adjacent rows of simulated bricks 10 (e.g., about ⅜ inches), such that abutment of the thinner offset portion 12 with the brick profile portion of an adjacent brick defines a gap sized to be filled with a mortar joint of the desired width. In other embodiments (not shown), a simulated brick may be provided with smaller offset portions (e.g., about 3/16 inches) extending from both lateral sides of the brick profile portion, such that abutment of the offset portions of adjacent rows of simulated bricks define a gap sized to be filled with a mortar joint of the desired width. In still other embodiments (not shown), a simulated brick may be provided with an offset portion extending from either or both of the longitudinal ends of the simulated brick, such that abutment of adjacent simulated bricks in a row defines a gap sized between adjacent longitudinal ends of the brick profile portions, to be filled with a mortar joint of the desired width.

The offset portion may be provided in a wide variety of suitable thicknesses, thick enough to function as a rigid spacer, and thin enough to provide sufficient space for grout material to provide the appearance of conventional brick masonry. The ratio of the thickness of the offset portion to the thickness of the brick profile portion may, for example, be between 5% and 70%, or between 35% and 60%. In one example, the offset portion thickness is about ⅝ inches.

The offset portion 12 of the simulated brick 10 may also provide additional insulation for the wall to which the simulated bricks are secured, as the core member material may have a significantly greater R-value than the mortar/grout component material (e.g., about 5.0 $h\cdot{}^\circ F\cdot ft^2\cdot in/BTU$ for the extruded polystyrene material of the core member compared to about 0.21 $h\cdot{}^\circ F\cdot ft^2\cdot in/BTU$ for the grout material). In one embodiment, the offset portion has an R-value of at least 1.0 $h\cdot{}^\circ F\cdot ft^2/BTU$. In an exemplary embodiment, the offset portion 12 is about ⅜ inches thick, with the offset portion having a section R-value of about 2.1 $h\cdot{}^\circ F\cdot ft^2/BTU$, compared to a section R-value of about 0.24 $h\cdot{}^\circ F\cdot ft^2/BTU$ for a comparable volume of grout material.

Figure 3:
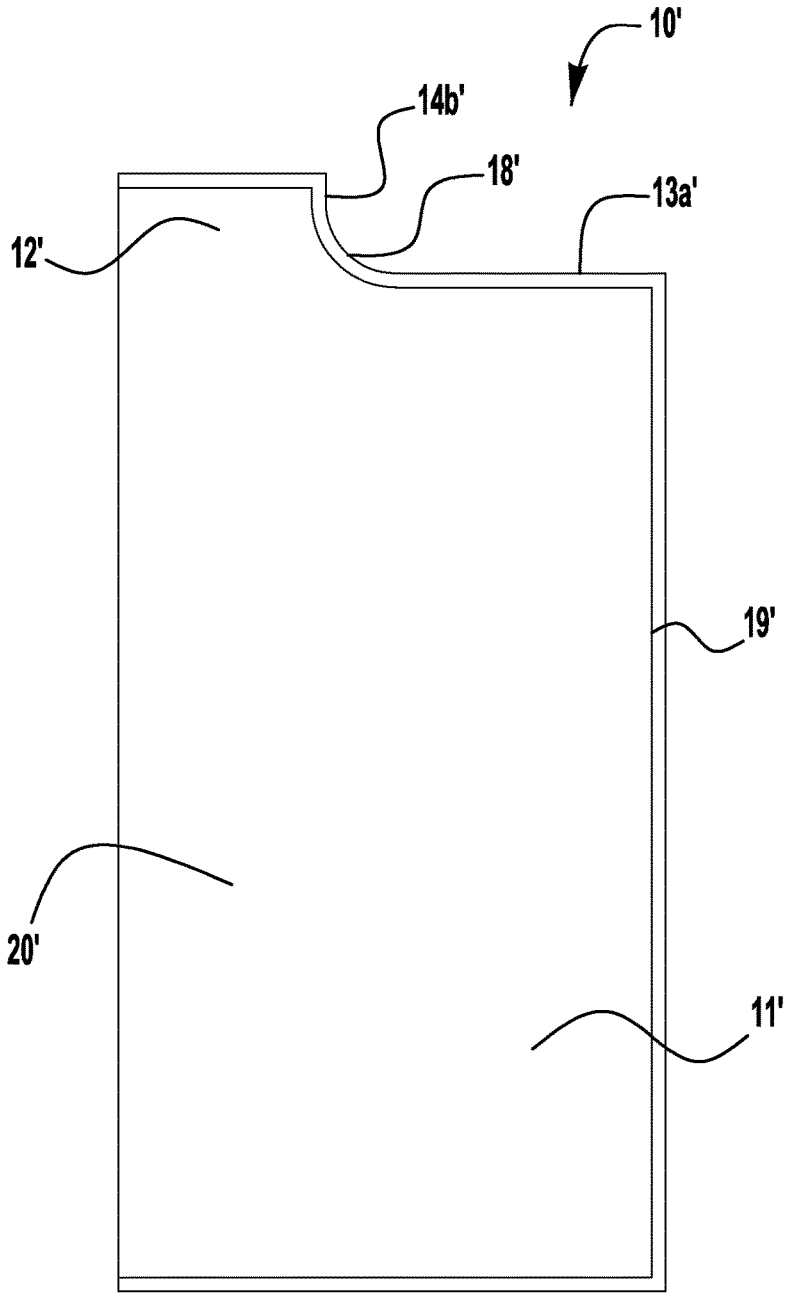
FIG. 3 shows an end view of an exemplary embodiment of a simulated brick wall cladding component.

In forming an exemplary simulated brick, in accordance with an exemplary aspect of the present application, an elongated block or sheet of the core member material (e.g., extruded polystyrene, or other insulation board) may be cut (e.g., hot wire cut) to form an elongated (e.g. about 2 to about 20 feet long, preferably about 4 to about 8 feet long) core defining the brick profile portion 11 and the offset portion 12, as shown. For ease of cutting, the junction between the outer surface 14*b*' of the offset portion 12' and the first lateral surface 13*a*' of the brick profile portion 11' may include a radius 18' (e.g., a radius of about ⅛ inch), as shown in the exemplary simulated brick 10' of FIG. 3. In other embodiments, the elongated shaped core may be extruded, molded, or otherwise formed without a cutting operation.

The mesh material is then adhered onto the lateral surfaces 13*a*, 13*b*, 13*c* and the outer surfaces 14*a*, 14*b* of the elongated core, for example, by applying (e.g., wrapping, pressing) a self-adhesive side of a mesh material sheet to the lateral and outer surfaces of the elongated core 20, for example, to hold the mesh material in place prior to application of the coating 40. The mesh material may be pre-cut to size for coverage of the elongated core, or trimmed after adhesion to remove any overhanging material.

A polymer modified cementitious basecoat material is prepared (e.g., by mixing) and is supplied, for example, in a hopper. The mesh-covered core is pushed (manually or using an automated system) through an extrusion coating machine to deposit or extrude (e.g., from a hopper above the extruding machine) the polymer modified cementitious basecoat material over the mesh layer 30 on the lateral surfaces 13*a*, 13*b*, 13*c* and the outer surfaces 14*a*, 14*b* of the core. The mesh material may be an open weave material, such that the basecoat material penetrates the mesh layer to adhere to the core material, which may further reinforce attachment of the mesh material to the core. In some embodiments, one or more additional layers of basecoat material may be applied.

A finish material (e.g., an acrylic-based architectural finish) is mixed or otherwise prepared, and is supplied, for example, in a hopper. Once the basecoat layer 43 has cured and/or dried and (optionally) has been inspected for imperfections, the coated core is pushed (manually or using an automated system) through an extrusion coating machine to deposit or extrude (e.g., from a hopper above the extruding machine) the finish material over the basecoat layer 43 on the lateral surfaces 13*a*, 13*b*, 13*c* and the outer surfaces 14*a*, 14*b* to form the finish layer 46. Prior to fully curing and/or drying, the finish layer may be treated (e.g., rolled, pressed, broadcast of additional materials, etc.) to provide a desired exterior texture or appearance.

Once the finish layer 46 has dried, the coated elongated core may be cut into brick-sized lengths (e.g., between about 3 inches and about 12 inches, or about 7-⅝ inches) to form multiple, substantially identical simulated bricks 10. The resulting simulated bricks may then be packaged, stored, and/or shipped for application to an exterior wall.

Figure 4:
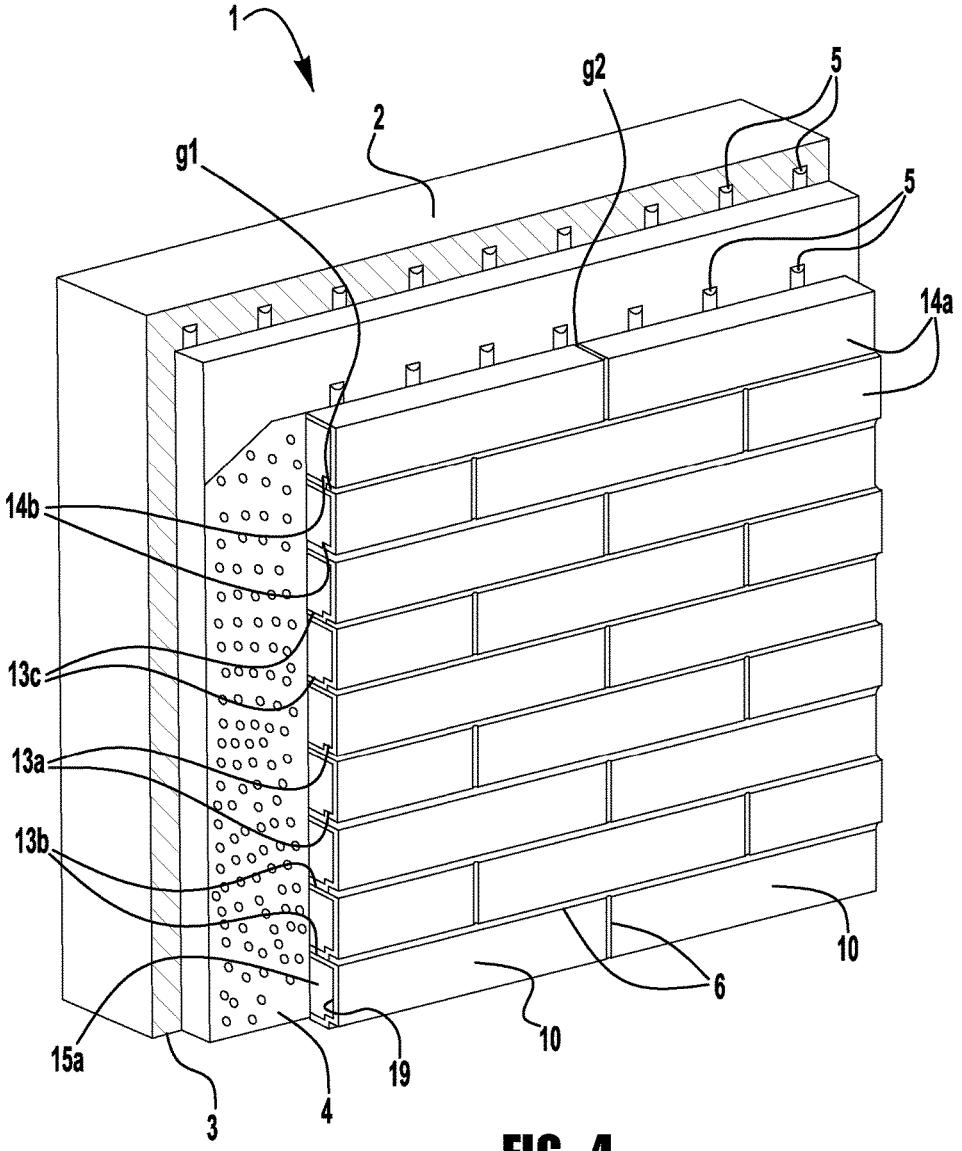
FIG. 4 shows a perspective view of cut-away exterior wall system including an array of simulated brick wall cladding components secured to an exterior wall substrate.

In accordance with various exemplary embodiments of the present application, a method of applying an array of simulated brick cladding components to an exterior wall is contemplated for forming an exterior wall system. In an exemplary method, base surface portions of simulated bricks (e.g., the simulated bricks described above and shown in FIGS. 1-3, and/or simulated bricks constructed using the methods described above) are secured to an exterior wall substrate using a suitable adhesive layer, such as polyurethane foam, polyurethane construction adhesive, acrylic based adhesive, or a polymer modified cementitious mortar as described herein. Suitable substrates include, for example, concrete, masonry, brick, plywood, oriented strand board, cement board, glass mat face gypsum sheathing, insulated concrete forms (ICFs), and EIFS basecoat. In an exemplary wall system 1, as shown in FIG. 4, a wall 2 (e.g., concrete, masonry, ICF, framed wall with sheathing) is coated with an EIFS cladding 3, which includes a fiberglass reinforced EIFS basecoat 4. While the simulated bricks may be secured directly to, and in uniform planar contact with, the EIFS basecoat 4, in the illustrated embodiment, the adhesive layer includes a series of spaced apart adhesive strips 5 or other such spacers are provided between the EIFS basecoat 4 and the base surface portions 16 of the simulated bricks 10, for example, to facilitate drainage of incidental water that may enter the cavity behind the bricks. Similar strips 5 may likewise be provided between the EIFS cladding 3 and basecoat 4.

As shown in FIG. 4, the simulated bricks 10 are secured to the EIFS basecoat wall surface in adjacent rows, with lateral end surfaces 13*c* of the offset portions 12 of the simulated bricks of a first row abutting the second lateral sides 13*b* of the simulated bricks of a second row, to define lateral gaps g1 between these lateral surfaces 13*b*, 13*c*. The simulated bricks 10 in each row may likewise be spaced from each other by longitudinal gaps g2, for example by manual user placement of the adjacent simulated bricks to provide such gaps g2, or by use of a longitudinally extending offset portion (not shown), as described above. Once the adhesive sufficiently cures, the gaps g1, g2 may be substantially filled by a grout or mortar material 6 applied between the bricks 10 and over the outer surfaces of the offset portions. In accordance with embodiments disclosed herein, the mortar or grout material used between the exterior wall cladding bricks in the systems disclosed herein may comprise the same or similar polymer modified cementitious mortar material that is used as the basecoat. As an alternative, an elastomeric sealant material may be used between the bricks. Preferably, the mortar/sealant imparts water resistance to the joints between the exterior wall cladding bricks.

The present disclosure is also directed to exterior wall cladding systems comprising the exterior wall claddings disclosed herein as applied to an exterior wall or exterior wall system. An exemplary wall system of the present disclosure may include an offset-aligned, multiple row array of simulated brick wall cladding components secured to an exterior wall surface by a mortar/grout material, with gaps between the adjacent simulated bricks filled by a mortar/grout material as shown in FIG. 4 and described above.

According to an inventive aspect of the present application, a simulated brick or other such building material cladding component (e.g., tile, panel, etc.) may be provided with one or more offset portions or spacing flanges on one or more edges of the cladding component, to provide uniform spacing between adjacent cladding components.

Figure 5:
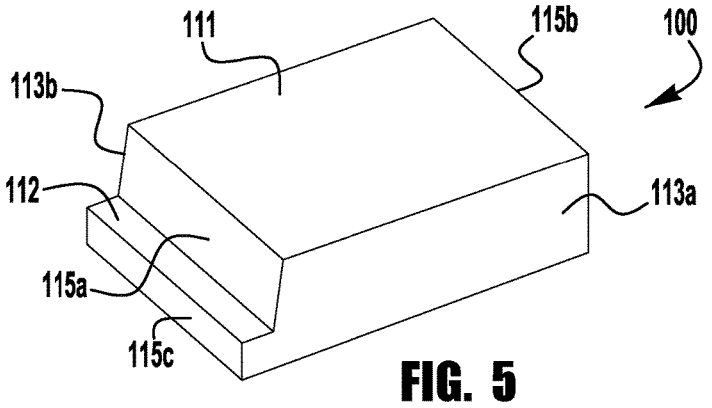
FIG. 5 illustrates an upper perspective view of a simulated brick wall cladding component according to an exemplary embodiment of the present disclosure.

As shown and described herein and in the '566 Application, a spacing flange or offset portion may extend along a lateral side of the brick (or other cladding component), to provide uniform spacing between adjacent rows of cladding components. In other embodiments, a spacing flange or offset portion may extend from a longitudinal end of the cladding component, to provide uniform spacing between adjacent cladding components within a row. FIG. 5 illustrates an exemplary simulated brick cladding component 100 including a main profile portion 111. The profile portion may, but need not, be generally in the shape of a thin brick (e.g., about 7⅝ inches long, about 2¼ inches wide, and about 1 inch thick, or about 7⅝ inches long, about 2⅝ inches wide, and about 1⅛ inches thick, or about 11⅝ inches long, about 4 inches wide, and about 1⅛ inches thick). The exemplary profile portion includes first and second lateral sides 113*a*, 113*b* extending between first and second longitudinal end surfaces 115*a*, 115*b* and to a planar outer surface to define a uniform thickness. A thinner flange, lip or offset portion 112 extending longitudinally from the first longitudinal end surface 115*a* of the brick profile portion 111 to a longitudinal end surface 115*c* of the offset portion. The brick profile portion 111 and the offset portion 112 together define a planar rectangular base surface 116 extending from the second longitudinal end 115*b* of the brick profile portion to the longitudinal end surface 115*c* of the offset portion 112.

In the exemplary embodiment, the offset portion 112 extends a distance corresponding to a desired width of a mortar joint to be applied between adjacent bricks 100 or other cladding component (e.g., about ⅜ inches) within a row of bricks, such that abutment of the thinner offset portion 112 with the brick profile portion of an adjacent brick defines a gap sized to be filled with a mortar joint of the desired width. In other embodiments, a simulated brick may be provided with smaller offset portions (e.g., about 3/16 inches) extending from both longitudinal ends of the brick profile portion, such that abutment of the offset portions of adjacent rows of simulated bricks define a gap sized to be filled with a mortar joint of the desired width.

Figure 6:
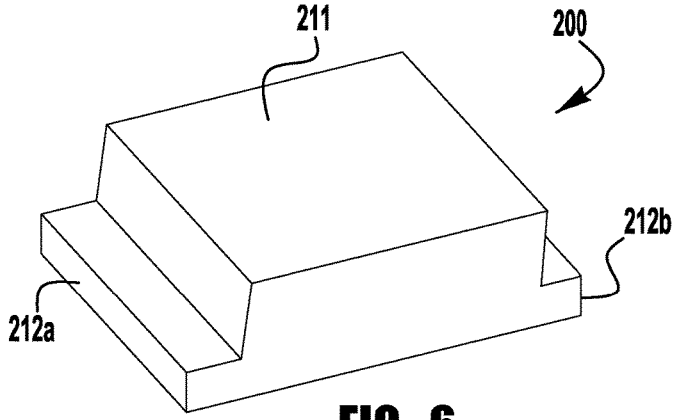
FIG. 6 illustrates an upper perspective view of another simulated brick wall cladding component according to an exemplary embodiment of the present disclosure.
Figure 7:
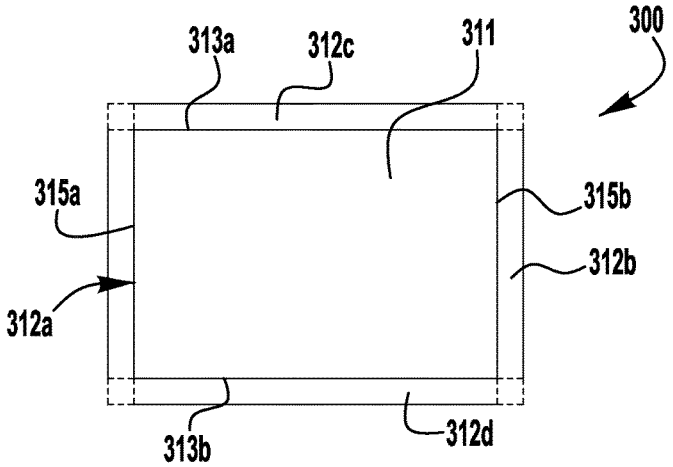
FIG. 7 illustrates a top view of another simulated brick wall cladding component according to an exemplary embodiment of the present disclosure.

In other embodiments, a simulated brick (or other cladding component) may be provided with flange or offset portions extending from one or both lateral sides of the profile portion and from one or both longitudinal ends of the profile portion, to provide uniform spacing between adjacent rows of cladding components, and between adjacent cladding components within a row. FIG. 6 illustrates an exemplary simulated brick cladding component 200 including a main profile portion 211 with a thinner flange, lip or offset portion 212*a* extending longitudinally from a first longitudinal end surface 215*a* of the profile portion 211, and with a thinner flange, lip or offset portion 212*b* extending laterally from a first lateral side surface 213*a* of the profile portion 211. These offset portions 212*a*, 212*b* may extend from the longitudinal end and lateral side surfaces by a dimension corresponding to the desired mortar joint width, such that abutment of the offset portions 212*a*, 212*b* with non-flanged longitudal end and lateral side surfaces of adjacent cladding components define gaps sized to be filled with mortar joints of the desired width. FIG. 7 illustrates an exemplary simulated brick cladding component 300 including a main profile portion 311 with thinner flange, lip or offset portions 312*a*, 312*b* extending longitudinally from first and second longitudinal end surfaces 315*a*, 315*b* of the profile portion 311, and with thinner flange, lip or offset portions 312*c*, 312*d* extending laterally from first and second lateral side surfaces 313*a*, 313*b* of the profile portion 311. These offset portions 312*a*, 312*b*, 312*c*, 312*d* may extend from the longitudinal end and lateral side surfaces by a dimension corresponding to about half of the desired mortar joint width, such that abutment of the offset portions of two adjacent and substantially identical cladding components define longitudinal and lateral gaps sized to be filled with mortar joints of the desired widths.

Figure 8A:
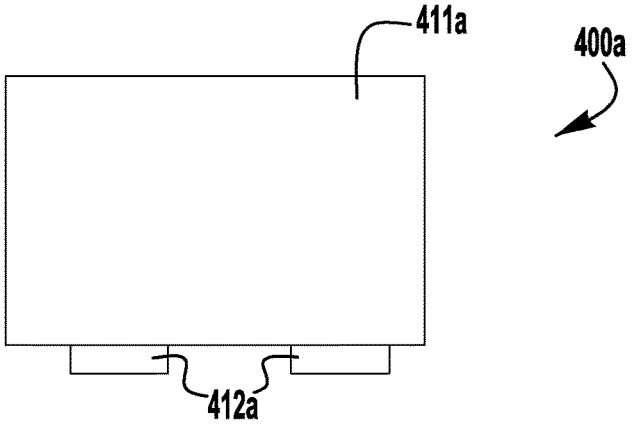
FIG. 8A illustrates a top view of another simulated brick wall cladding component according to an exemplary embodiment of the present disclosure.
Figure 8B:
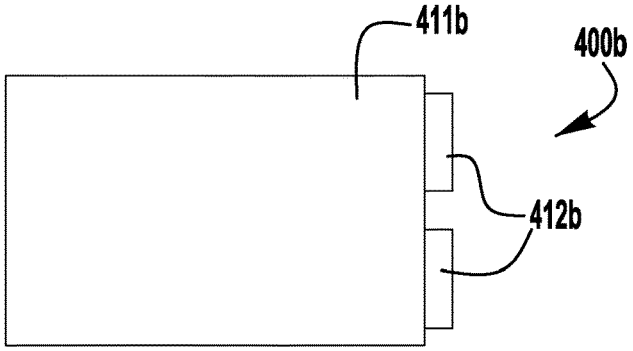
FIG. 8B illustrates a top view of another simulated brick wall cladding component according to an exemplary embodiment of the present disclosure.
Figure 8C:
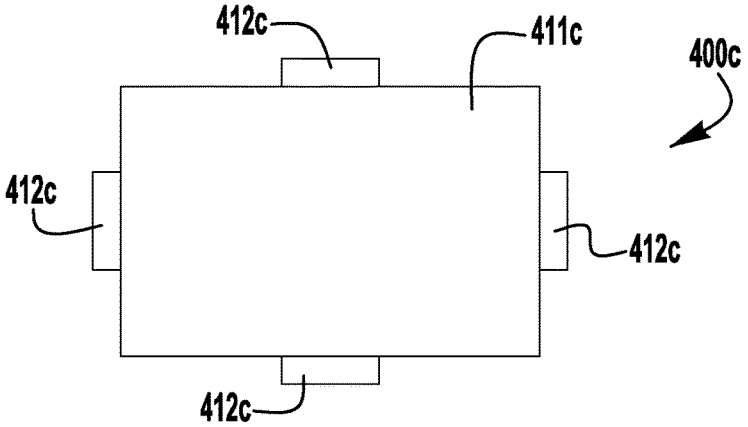
FIG. 8C illustrates a top view of another simulated brick wall cladding component according to an exemplary embodiment of the present disclosure.

In the embodiments shown and described in the '566 Application, and in the embodiments of FIGS. 1-7 described above, the offset portions extend from an entire lateral side or an entire longitudinal end of the brick profile portion. According to another aspect of the present application, in other embodiments, the offset portion may extend from one or more discrete portions of the lateral side and/or longitudinal end of the brick profile portion, for example, to reduce weight and/or material, as compared to an offset portion extending from the entire end or side. FIGS. 8A, 8B, and 8C illustrate exemplary embodiments of a simulated brick cladding component 400*a*, 400*b*, 400*c* having different discrete offset portions 412*a*, 412*b*, 412*c*.

In the embodiments shown and described in the '566 Application, the longitudinally extending, lateral offset portion may be formed by cutting (e.g., hot wire cutting), extruding, molding, 3D printing, or otherwise forming the offset portion as a rigid extension from the lateral side surface of the profile portion. According to another aspect of the present application, in other embodiments, the offset portion may be a separate spacer component that is attached to or assembled with either or both of the lateral sides and/or longitudinal ends of the cladding component profile portion, before or during installation of the cladding components on a building or other such structure. This may facilitate easier or more efficient manufacture of the cladding component, and/or may allow for providing the offset portion in a different material (e.g., for enhanced insulation properties, fire resistance properties, elimination of unnecessary materials/properties along the mortar joints, etc.).

Figure 9A:
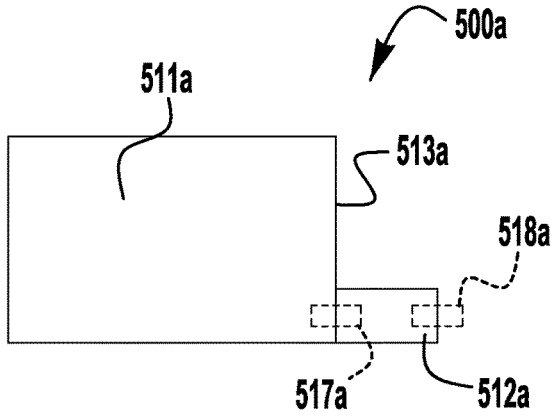
FIG. 9A illustrates a front view of another simulated brick wall cladding component according to an exemplary embodiment of the present disclosure.
Figure 9B:
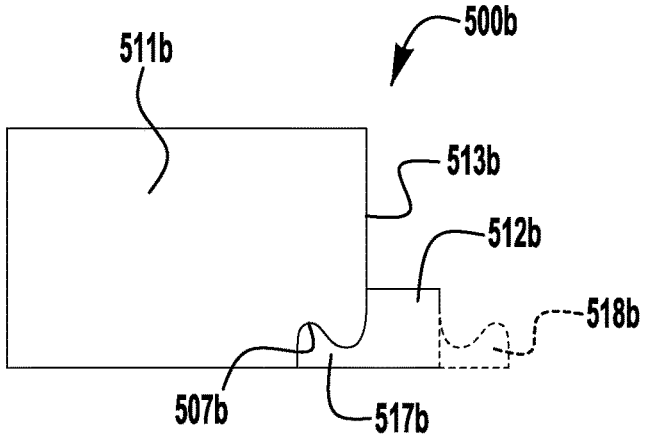
FIG. 9B illustrates a front view of another simulated brick wall cladding component according to an exemplary embodiment of the present disclosure.
Figure 9C:
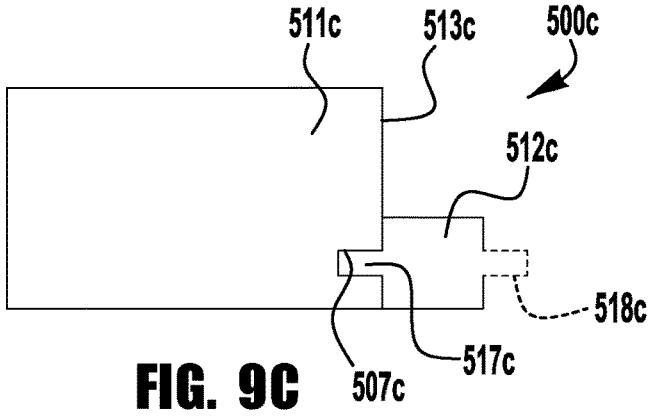
FIG. 9C illustrates a front view of another simulated brick wall cladding component according to an exemplary embodiment of the present disclosure.

FIGS. 9A, 9B, and 9C illustrate exemplary embodiments of a cladding component 500*a*, 500*b* having a separate spacer component 512*a*, 512*b*. In the embodiment of FIG. 9A, the spacer component 512*a* is secured to a substantially flush side surface 513*a* of the profile portion 511*a* by an attachment arrangement, shown schematically at 517*a*. The attachment arrangement may include any suitable materials and/or components, including, for example, adhesives, welding, and fasteners, such as nails, staples, clamps, and hook-and-loop fasteners. The spacer component 512*a* may be provided with a second attachment arrangement, shown schematically at 518*a*, for eventual attachment to a profile portion of an adjacent cladding component.

In the embodiments of FIGS. 9B and 9C, the spacer component 512*b*, 512*c* is secured to the side surface 513*b*, 513*c* of the profile portion 511*b*, 511*c* by an interlocking arrangement. In the embodiment of FIG. 9B, the spacer component 512*b* includes a hook portion 517*b* that interlocks with a recessed portion 507*b* on the underside of the profile portion 511*b*. The hook portion 517*b* and recessed portion 507*b* may, but need not, be provided with a interference fit to maintain attachment of the spacer component 512*b* to the profile portion 511*b* prior to installation of the cladding component 500*b* on a wall surface. As shown, the spacer component 512*b* may, but need not, be provided with a second hook portion 518*b* for interlocking with a recessed portion of an adjacent cladding component (e.g., before or during installation). In the embodiment of FIG. 9C, the spacer component 512*c* includes a tab portion 517*c* that interlocks with a slot portion 507*c* in the side surface 513*c* of the profile portion 511*c*. The tab portion 517*c* and slot portion 507*c* may, but need not, be provided with a interference fit to maintain attachment of the spacer component 512*c* to the profile portion 511*c* prior to installation of the cladding component 500*c* on a wall surface. As shown, the spacer component 512*c* may, but need not, be provided with a second tab portion 518*c* for interlocking with a recessed portion of an adjacent cladding component (e.g., before or during installation).

According to another aspect of the present application, a cladding system may be provided with adaptable offset portions to selectively vary the offset or spacing between adjacent cladding components. As one example, a cladding component may be provided with an offset portion or flange that may be selectively segmented, cut, or severed to a desired offset dimension. For example, the offset portions (e.g., the offset portions of the embodiments of FIGS. 5-7) may be provided with demarcations for identifying selectable offset dimensions. These selectable offset flange locations may additionally or alternatively be provided with notches, grooves, or perforations to facilitate shortening the offset portion to correspond to the desired offset dimension. As another example, a cladding system may be provided with separate spacer components (e.g., the spacer components of FIGS. 9A, 9B, and 9C) having varying lateral widths, such that the assembler or installer may select and utilize a spacer component having a lateral width corresponding to the desired offset dimension.

The cladding components of the '566 Application, and the exemplary embodiments described herein, may be formed from a polymeric core member, a mesh layer adhered to the core member, and a coating comprising an inner, basecoat layer directly deposited (e.g., by extrusion coating) onto the mesh layer to cover the mesh layer and to provide strength and fire barrier properties, and a finish layer deposited (e.g., by extrusion coating) onto the basecoat layer to provide desired surface durability and exterior aesthetic properties. In other embodiments, additional coating layers may be provided. In still other embodiments, the basecoat layer may be provided with integral reinforcement materials, for example, to eliminate the separate mesh layer, and/or integral color and/or texture properties, for example, to eliminate the separate finish layer.

In accordance with certain embodiments, the exterior wall cladding (e.g., simulated bricks) may be applied to any common exterior wall surface, including, plywood, oriented strand board, glass mat gypsum sheathing, cement board sheathing, ICF's, exterior insulation and finish system ("EIFS") basecoat, concrete, and masonry. Typically, square-edged insulation bricks (which are not in accordance with the present disclosure) are applied to an uncoated expanded polystyrene core member that has built-in projecting strips or offsets, thereby allowing the squared-edged brick to maintain its position on the wall without sliding. Square-edged insulation bricks applied to other surfaces require the use of tile spacers or metal pans and clips to allow the bricks to stay in position without sliding and also to keep a consistent grout joint.

In other exemplary aspects of the present application, one or more of the cladding components of the '566 Application, and the exemplary embodiments described herein, may be applied to an interior wall surface, ceiling surface, deck, patio, roof, or other such substrate. The cladding components employed in such applications may be adapted to meet all relevant standards (e.g., fire codes, etc.).

In exemplary embodiments, a wall or other such building substrate is coated with a basecoat (e.g., an EIFS cladding), and may (but need not) include an adhesive layer formed from a series of spaced apart adhesive strips between the basecoat and the base surface portions of the cladding components, for example, to facilitate drainage of incidental water that may enter the cavity behind the bricks. Additionally or alternatively, the cladding components may be secured to the substrate by other adhesives or mechanical means, including, for example, snaps, clamps, nails, and/or screws. In one such exemplary embodiment, a cladding component may be provided with an offset defining flange or offset portion that includes one or more mounting holes to facilitate secure attachment (e.g., with nails or bolts) of the cladding component to the substrate.

Figure 10:
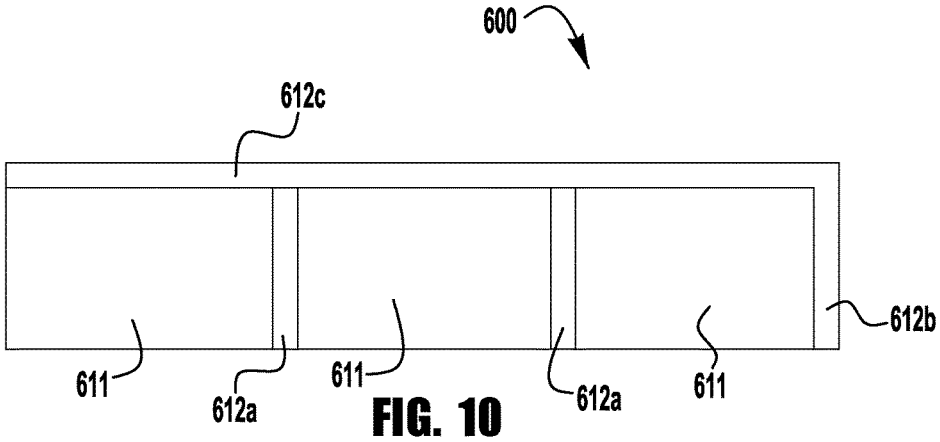
FIG. 10 illustrates a top view of a multiple simulated brick panel wall cladding component according to an exemplary embodiment of the present disclosure.
Figure 11:
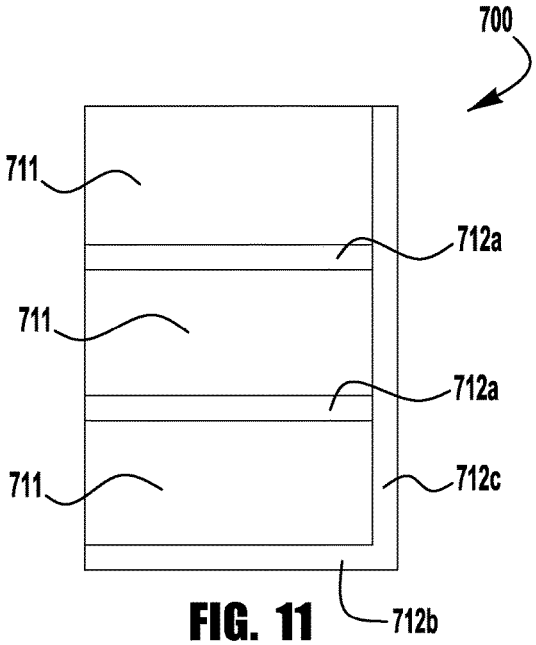
FIG. 11 illustrates a top view of another multiple simulated brick panel wall cladding component according an exemplary embodiment of to the present disclosure.

According to another aspect of the present application, multiple brick profile portions (or other architectural elements) may be prefabricated together in panel form for application together to a wall or other such substrate. FIG. 10 illustrates an exemplary panel 600 including a row of multiple brick profile portions 611 separated from each other by intermediate offset portions 612*a*. One or both of the endmost brick profile portions may be provided with an outer longitudinal offset portion 612*b* to provide a mortar joint offset, as described herein, when the panel is installed with the outer offset portion 612*b* in abutment with a longitudinal end surface of an adjacent brick profile portion (e.g., an endmost brick profile portion of an adjacent multiple brick profile panel). Additionally or alternatively, the panel 600 may be provided with a lateral offset portion or flange 612*c* extending from either or both of the lateral side portions of the brick profile portions to provide a mortar joint offset, as described herein, when the panel is installed with the lateral offset portion 612*c* in abutment with a lateral side surface of an adjacent brick profile portion (e.g., an endmost brick profile portion of an adjacent multiple brick profile panel). FIG. 11 illustrates an exemplary panel 700 including a column of multiple brick profile portions 711 separated from each other by intermediate offset portions 712*a*. At least one of the endmost brick profile portions may be provided with an outer lateral offset portion 712*b* to provide a mortar joint offset, as described herein, when the panel is installed with the outer offset portion 712*b* in abutment with a lateral end surface of an adjacent brick profile portion (e.g., an endmost brick profile portion of an adjacent multiple brick profile panel). Additionally or alternatively, the panel 700 may be provided with a longitudinal offset portion or flange 712*c* to provide a mortar joint offset, as described herein, when the panel is installed with the lateral offset portion 712*c* in abutment with a lateral side surface of an adjacent brick profile portion (e.g., an endmost brick profile portion of an adjacent multiple brick profile panel). In other embodiments (not shown), a panel may be provided with an array of multiple rows and multiple columns of brick profile portions, with both intermediate and outer offset portions to define mortar joint locations.

The multiple brick profile panels 600, 700 of FIGS. 10 and 11 may be fabricated as a unitary panel by any suitable method, including, for example, cutting (e.g., hot wire cutting), extruding, molding, or 3D printing. Alternatively, a multiple brick (or other such element) panel may be formed by attaching separate spacer components between adjacent brick profile portions, for example, as described in greater detail above and as shown in the embodiments of FIGS. 9A, 9B, and 9C.

According to another aspect of the present application, a wall cladding system including, for example, one or more of simulated brick components (e.g., any one or more of the exemplary simulated bricks described herein and in the '566 Application), may be provided with a starter board fastened to a base portion of a wall substrate to provide a ledge or flange for supporting and aligning the wall cladding components as these components are being affixed to the wall substrate. In one embodiment, the starter board includes a board profile portion sized to substantially match or correspond with a base insulation board of the system, and a flange portion extending outward from a front surface of the board profile portion to define a supporting ledge for a base or bottom row of wall cladding components.

Figure 12:
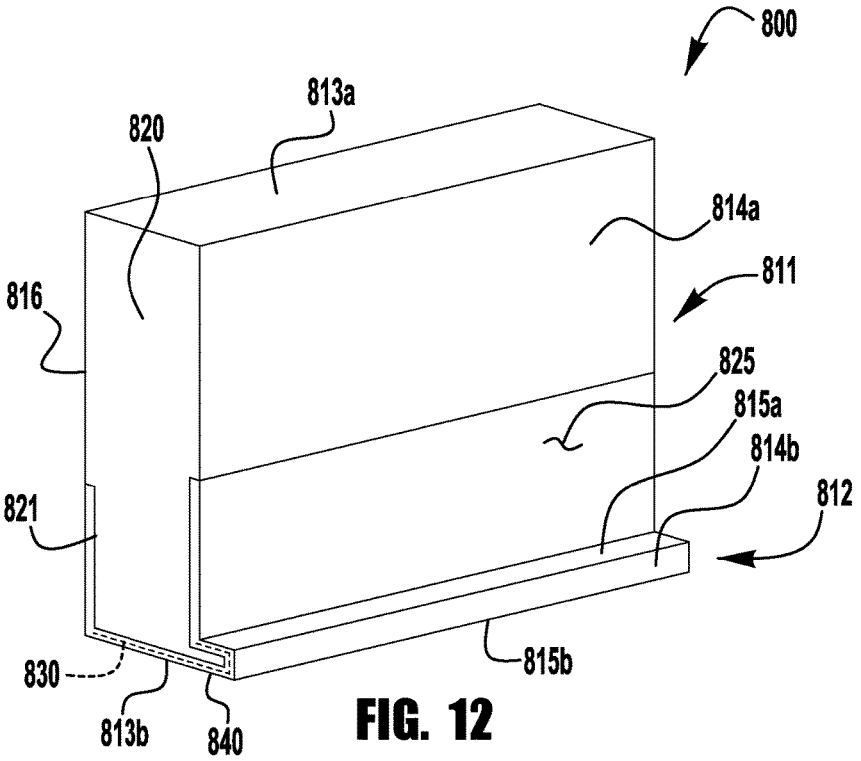
FIG. 12 illustrates a perspective view of a starter board for use with simulated brick wall cladding components according to an exemplary embodiment of the present disclosure.
Figure 13:
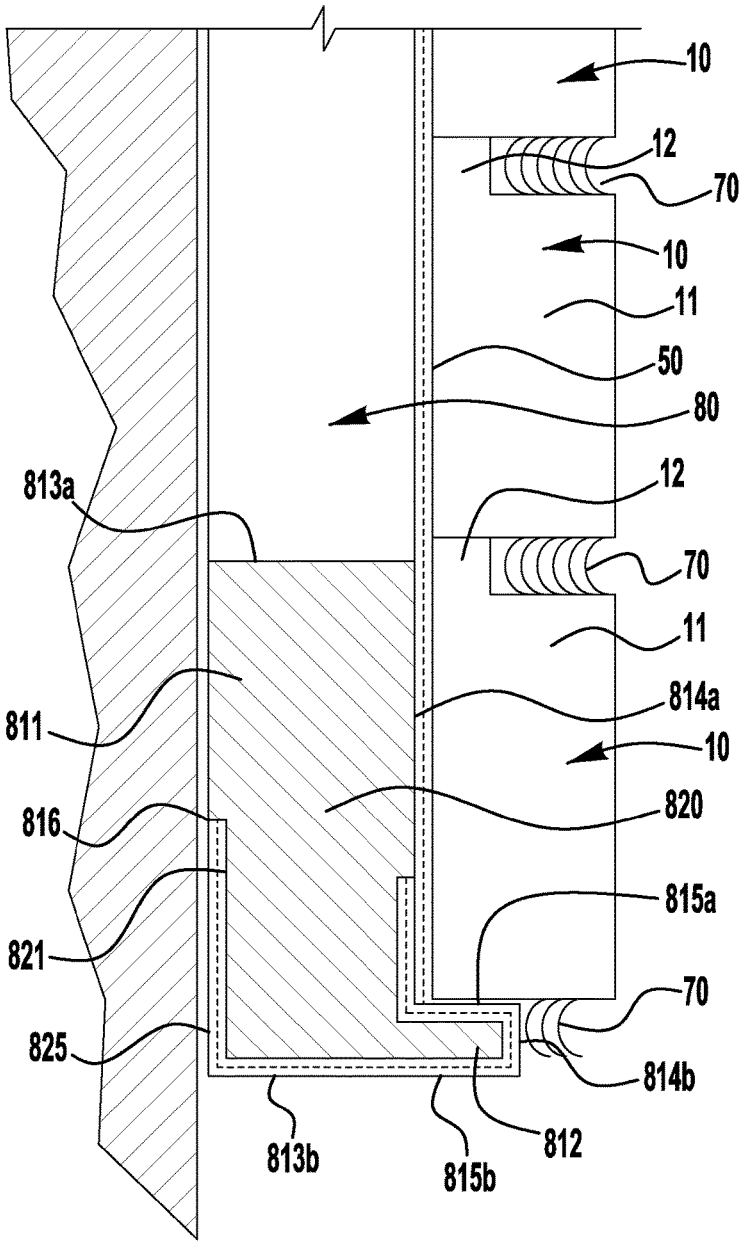
FIG. 13 illustrates a side view of a simulated brick wall cladding system according to an exemplary embodiment of the present disclosure.

As shown in FIGS. 12 and 13, an exemplary starter board 800 includes a board profile portion 811, generally in the shape of a base insulation board (e.g., between about 4 inches and about 24 inches high, between about 1 inch and about 13 inches thick, and to any practicable length), and a supporting flange portion 812. The exemplary board profile portion includes parallel, planar base and outer surfaces 816, 814*a* defining a uniform thickness, with the supporting flange portion 812 extending outward from the planar outer surface 814*a* to an outer surface 814*b* (which may, but need not, be planar) of the flange portion 812. The planar rectangular base surface 816 extending from a first lateral surface 813*a* of the board profile portion 811 to a second lateral surface 813*b* of the board profile portion, which may, but need not, be coplanar with an outer lateral surface 815*b* of the supporting flange portion 812. The starter board 800 may be provided in any desired length, such as, for example, 4, 6, or 8 foot long components.

As shown, the starter board 800 may be formed from a polymeric core member 820, such as, for example, expanded polystyrene ("EPS"), extruded polystyrene ("XPS"), or other insulation materials, including, for example, polyisocyanurate, polyurethane, and foam glass. In certain embodiments, the core member includes a polymer material having a density of about 0.5 to about 5 pcf, or about 1 to about 2 pcf, or about 1.5 pcf. In an exemplary embodiment, the core comprises EPS having a density of about 1.0 pcf. In accordance with certain exemplary embodiments, the core is an XPS meeting ASTM C578. The insulative polymer core member may provide an effective R-value between about 2 and about 8 h·° F.·ft$^2$·in/BTU. In an exemplary embodiment, an EPS core member has an R-value of about 3.9 h·° F.·ft$^2$·in/BTU.

The starter board 800 may be provided with a laminate 825, which may include a reinforcing mesh and basecoat, which may be consistent with the reinforcing mesh and basecoat layers of the simulated bricks of the '566 Application. While the laminate may cover the entire periphery of the starter board, in an exemplary embodiment, the laminate 825 is applied to the flanged lateral end of the board 800, as the portion that is not covered by the installed simulated bricks (or other such wall cladding components). In the illustrated embodiment of FIGS. 12 and 13, the laminate 825 covers the second lateral surface 813*b* of the board profile portion 811, the inner and outer lateral surfaces 815*a*, 815*b* of the supporting flange portion 812, the outer surface 814*b* of the supporting flange portion 812, and portions of the base and outer surfaces 816, 814*a* of the board profile portion proximate the supporting flange portion 812. In an exemplary embodiment, the laminate 825 extends to cover about 2 inches of a 7 inch wide base surface 816, and about 2½ inches of the outer surface 814*a*. The size and extent of the laminate layer may be selected, for example, to allow for overlap of the reinforcing mesh and basecoat from the field of the wall to maintain continuity of the reinforcing layer and the weather resistant layer. As shown the core member 820 may be provided with a recessed or inset portion 821 sized to receive the laminate 825 for flush or uniform base and outer surfaces 816, 814*a* of the board profile portion 812.

In the exemplary embodiment, the supporting flange portion 812 has a width that corresponds to a desired width of a mortar joint to be applied between adjacent rows of simulated bricks 10 (e.g., about ⅜ inch, or about ½ inch), such that abutment of the supporting flange portion 812 with a floor, molding or other lateral surface defines a gap sized to be filled with a mortar joint of the desired width. The width of the supporting flange portion may also be selected to provide sufficient support strength for the wall cladding components to be supported by the flange portion.

The supporting flange portion 812 may be provided with a height or thickness that is large enough to function as a rigid spacer, and thin enough to provide sufficient space for grout material to provide the appearance of conventional brick masonry when combined with simulated bricks 10 (or other such wall cladding components) secured to the board, as shown in FIG. 13. The ratio of the thickness/height of the flange portion 812 to the thickness of the brick profile portion of the mounted simulated brick may, for example, be between 5% and 70%, or between 35% and 60%, and may, but need not, be comparable to the thickness of the offset portion 12 of the simulated brick 10. In one example, the flange portion thickness is about ½ inch.

The flange portion 812 of the starter board 800 may also provide additional insulation for the wall to which the simulated bricks are secured, as the core member material may have a significantly greater R-value than the mortar/grout component material (e.g., about 3.9 $h\cdot^{\circ}$ $F.\cdot ft^2\cdot in/BTU$ for the expanded polystyrene material of the core member compared to about 0.21 $h\cdot^{\circ}$ $F.\cdot ft^2\cdot in/BTU$ for the grout material).

In constructing an exemplary starter board 800, in accordance with an exemplary aspect of the present application, an elongated block or sheet of the core member material (e.g., expanded polystyrene, or other insulation board) may be cut (e.g., hot wire cut) to form an elongated (e.g. about 2 to about 20 feet long, preferably about 4 to about 8 feet long) core member 820 defining the board profile portion 811 and the flange portion 812, as shown. A recessed or inset portion 821 may be cut into portions of the base and outer surfaces 816, 814*a* proximate the flange portion 812. For ease of cutting, the junction between the outer surface 814*a* of the board profile portion 811 and the inner lateral surface 813*a* of the flange portion 812 may include a radius (e.g., a radius of about ½ inch, not shown). In other embodiments, the elongated shaped core may be extruded, molded, or otherwise formed without a cutting operation.

A mesh material 830 (e.g., as described in the '566 Application) is then adhered to the second lateral surface 813*b* of the board profile portion 811, the inner and outer lateral surfaces 815*a*, 815*b* of the supporting flange portion 812, the outer surface 814*b* of the supporting flange portion 812, and the recessed portions 821 of the base and outer surfaces 816, 814*a* of the board profile portion proximate the supporting flange portion 812, for example, by applying (e.g., wrapping, pressing) a self-adhesive side of a mesh material sheet 830 to the lateral and outer surfaces of the elongated core 820, to hold the mesh material in place prior to application of a basecoat. The mesh material may be pre-cut to size for coverage of the elongated core, or trimmed after adhesion to remove any overhanging material.

A polymer modified cementitious basecoat material (e.g., as described in the '566 Application) is prepared (e.g., by mixing) and is supplied, for example, in a hopper. The mesh-covered core is pushed (manually or using an automated system) through an extrusion coating machine to deposit or extrude (e.g., from a hopper above the extruding machine) the polymer modified cementitious basecoat material 840 over the mesh layer 830 on the mesh covered surfaces 813*b*, 815*a*, 815*b*, 814*b*, 816, 814*a*. The mesh material may be an open weave material, such that the basecoat material penetrates the mesh layer to adhere to the core material, which may further reinforce attachment of the mesh material to the core. In some embodiments, one or more additional layers of basecoat material may be applied. Additionally, at least the outer surface 814*b* of the flange portion 812 may be color coated (e.g., with an acrylic-based architectural finish), to match the color of the mortar to be used with the simulated bricks of the wall cladding system.

In use, in accordance with an exemplary method (as shown in FIG. 13), the base surface 816 of the starter board 800 is secured to a building substrate using a suitable adhesive layer, such as polyurethane foam, polyurethane construction adhesive, acrylic based adhesive, or a polymer modified cementitious mortar. Suitable substrates include, for example, concrete, masonry, stucco, brick, plywood, oriented strand board, cement board, glass mat face gypsum sheathing, insulated concrete forms (ICFs). One or more insulation boards 80 having a thickness that substantially matches the thickness of the board profile portion 811 are secured to the substrate S above the starter board 800 to complete the surface to which the simulated bricks 10 are attached.

While the simulated bricks may be attached directly to the starter board 800 and insulation board 80, in an exemplary embodiment, as shown in FIG. 13, a mesh reinforced basecoat membrane 50 is applied to the outer surfaces of the starter board 800 and insulation board 80, with the basecoat membrane 50 contacting and adhering to the basecoat layer 850 of the starter board 800 to maintain continuity of the reinforcement. A bottom row of simulated bricks 10 are adhered to the basecoat membrane 50 (e.g., by a polyurethane foam, polyurethane construction adhesive, acrylic based adhesive, or polymer modified cementitious mortar), with the lateral side of the simulated brick 10 opposite the offset portion being supported and aligned by the projecting flange portion 812, to prevent slippage of the simulated brick components as the mortar/adhesive dries or sets. As described in the '566 Application, additional rows of simulated bricks are adhered to the basecoat membrane 50, with the offset portions providing uniform gaps between the rows of brick components. These gaps may be substantially filled by a grout or mortar material 70 applied between the bricks 10 and over the outer surfaces of the offset portions. A grout or mortar material may also be applied to the outer surface of the flange portion 812 to provide a consistent appearance. In accordance with embodiments disclosed herein, the mortar or grout material used between the exterior wall cladding bricks in the systems disclosed herein may comprise the same or similar polymer modified cementitious mortar material that is used as the basecoat. As an alternative, an elastomeric sealant material may be used between the bricks. Preferably, the mortar/sealant imparts water resistance to the joints between the exterior wall cladding bricks.

Figure 14:
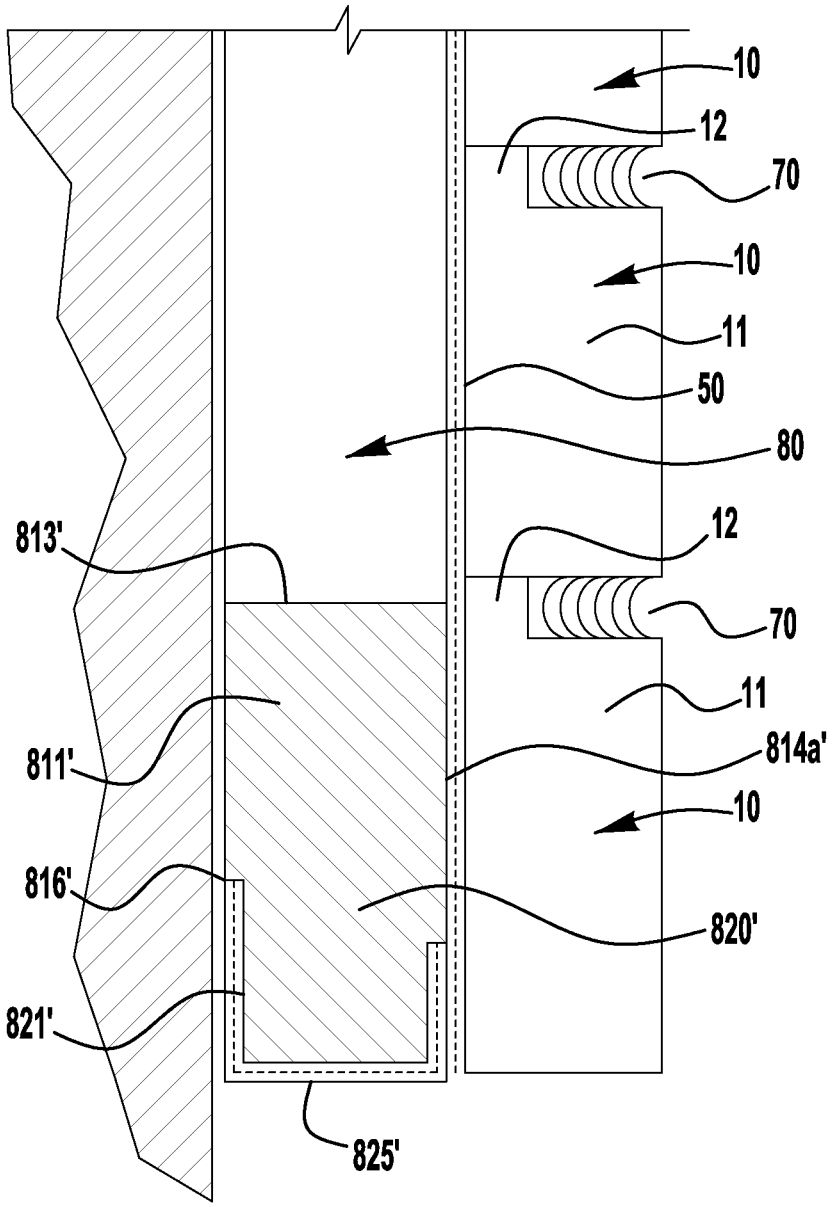
FIG. 14 illustrates a side view of a simulated brick wall cladding system according to another exemplary embodiment of the present disclosure.

In other embodiments, as shown in FIG. 14, a starter board 800' may be provided without a flange portion, and may rely on other means of attachment of a first row of simulated bricks 10, such as, for example, fasteners and/or adhesives. In the illustrated embodiment, the laminate 825' is applied to the second lateral surface 813*b*' of the board core member 820' and portions of the base and outer surfaces 816', 814*a*' of the board profile portion proximate the supporting flange portion 812. In an exemplary embodiment, the laminate 825 extends to cover about 2 inches of a 7 inch wide base surface 816', and about 2½ inches of the outer surface 814*a*'. The size and extent of the laminate layer may be selected, for example, to allow for overlap of the reinforcing mesh and basecoat from the field of the wall to maintain continuity of the reinforcing layer and the weather resistant layer. As shown the core member 820' may be provided with a recessed or inset portion 821' sized to receive the laminate 825' for flush or uniform base and outer surfaces 816', 814*a*' of the board profile portion 812'.

Figure 15:
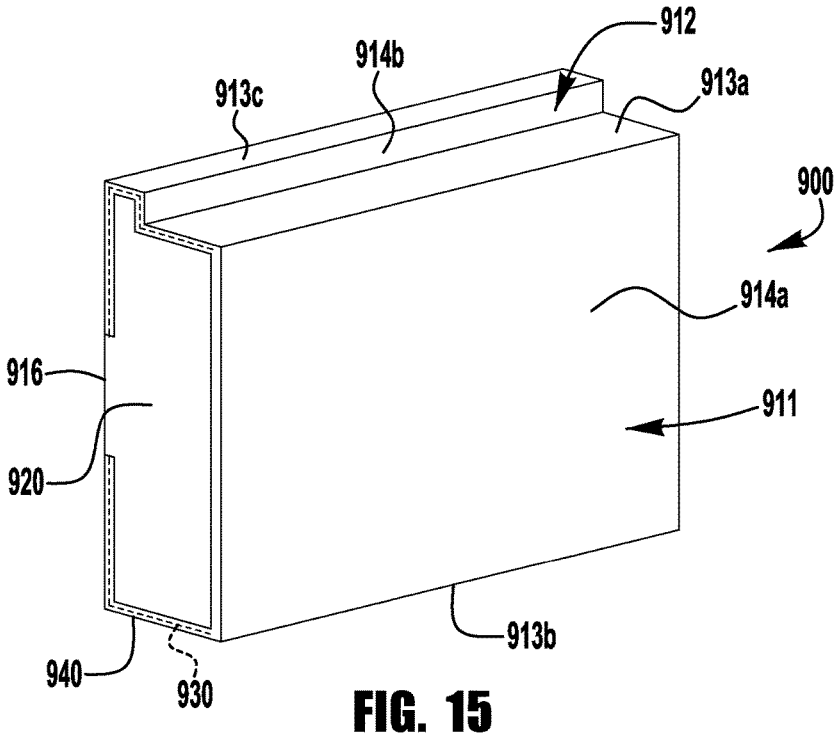
FIG. 15 illustrates a perspective view of a banding board according to an exemplary embodiment of the present disclosure.

Other wall cladding components may additionally or alternatively be produced and installed in accordance with the present application. As one example, a coated insulation board component may be prepared to simulate precast concrete accent bands, for example, along floor lines and window heads. FIG. 15 illustrates an exemplary banding component 900 having a board profile portion 911 and offset portion 912 similar to the brick profile portion 11 and offset portion 12 of the simulated bricks 10 of FIGS. 1-4 and the '566 Application.

Similar to the simulated bricks of FIGS. 1-4 and the '566 Application, the banding component may be formed cutting a core material (e.g., expanded polystyrene or extruded polystyrene, foam glass, polyisocyanurate, graphite enhanced polystyrene) into an elongated core 920 defining the board profile portion 911 and the offset portion 912, for example, using a hot wire cutting machine. The height/thickness of the banding board profile portion 911 may be sized to match the height of a simulated brick profile portion of a course of simulated bricks (e.g. the simulated bricks 10 of the '566 Application) used with the banding board 900 in an exemplary wall cladding system, and the height/thickness of the banding board offset portion 912 may be sized to match the height of the simulated brick offset portion. The board core portions may be cut into desirable modular lengths (e.g., 4, 6, or 8 foot lengths). A groove may be cut into one edge of the board (e.g., using a router) to form the offset portion 912.

A mesh material (e.g., as described in the '566 Application) is adhered to the first and second lateral surfaces 913*a*, 913*b* of the board profile portion 911, the outer lateral surface 913*c* of the supporting flange portion 912, the outer surfaces 914*a*, 914*b* of the board profile portion 911 and the supporting flange portion 912, for example, by applying (e.g., wrapping, pressing) a self-adhesive side of a mesh material sheet 930 to the lateral and outer surfaces of the elongated core 920, to hold the mesh material in place prior to application of a basecoat. As shown, the mesh material may, but need not, extend onto portions of the base surface of the board profile portion, proximate the lateral edges. The mesh material may be pre-cut to size for coverage of the elongated core, or trimmed after adhesion to remove any overhanging material.

The mesh-covered core is pushed (manually or using an automated system) through an extrusion coating machine to deposit or extrude (e.g., from a hopper above the extruding machine) a polymer modified cementitious basecoat material 940 (e.g., as described in the '566 Application) over the mesh layer 930 on the mesh covered surfaces. The mesh material may be an open weave material, such that the basecoat material penetrates the mesh layer to adhere to the core material, which may further reinforce attachment of the mesh material to the core. In some embodiments, one or more additional layers of basecoat material may be applied. A finish layer (e.g., as described in the '566 Application) may be applied to the basecoat layer to simulate a desired architectural finish, such as, for example, precast concrete. The finished boards may be installed on a wall substrate as part of a wall cladding system, for example, above windows, at floor lines, and other locations where such accent pieces may be desired.

Unless otherwise indicated herein, all sub-embodiments and optional embodiments are respective sub-embodiments and optional embodiments to all embodiments described herein. While the present application has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. Therefore, the application, in its broader aspects, is not limited to the specific details, the representative compositions or formulations, and illustrative examples shown and described. Accordingly, departures may be made from such details without departing from the spirit or scope of the applicant's general disclosure herein.

Unless otherwise defined, all technical and scientific terms used herein have the same meaning as commonly understood by one of ordinary skill in the art. In case of conflict, the present document, including definitions, will control. Preferred methods and materials are described below, although methods and materials similar or equivalent to those described herein may be used in practice or testing of the nutritional composition. The materials, methods, and examples disclosed herein are illustrative only and not intended to be limiting.

The terms "comprise(s)," "include(s)," "having," "has," "can," "contain(s)," and variants thereof, as used herein, are intended to be open-ended transitional phrases, terms, or words that do not preclude the possibility of additional acts or structures. The singular forms "a," "an" and "the" include plural references unless the context clearly dictates otherwise. The present disclosure also contemplates other embodiments "comprising," "consisting of" and "consisting essentially of," the embodiments or elements presented herein, whether explicitly set forth or not. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use.

All percentages, parts, and ratios as used herein are by weight of the total product, unless specified otherwise. All ranges and parameters, including but not limited to percentages, parts, and ratios, disclosed herein are understood to encompass any and all sub-ranges assumed and subsumed therein, and every number between the endpoints. For example, a stated range of "1 to 10" should be considered to include any and all sub-ranges beginning with a minimum value of 1 or more and ending with a maximum value of 10 or less (e.g., 1 to 6.1, or 2.3 to 9.4), and to each integer (1, 2, 3, 4, 5, 6, 7, 8, 9, and 10) contained within the range.

All combinations of method or process steps as used herein can be performed in any order, unless otherwise specified or clearly implied to the contrary by the context in which the referenced combination is made.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, hardware, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

While the present invention has been illustrated by the description of embodiments thereof, and while the embodiments have been described in considerable detail, it is not the intention of the applicant to restrict or in any way limit the scope of the invention to such detail. Additional advantages and modifications will readily appear to those skilled in the art. For example, the specific locations of the component connections and interplacements can be modified. Therefore, the invention, in its broader aspects, is not limited to the specific details, the representative apparatus, and illustrative examples shown and described. Accordingly, departures can be made from such details without departing from the spirit or scope of the applicant's general inventive concept.

We claim:

1. A starter board for a wall cladding system, the starter board comprising:

a core member defining a board profile portion including parallel, planar base and outer surfaces defining a uniform thickness, the base surface extending from a first lateral surface to a second lateral surface, and a supporting flange portion including inner and outer lateral surfaces extending outward from the planar outer surface, at the second lateral surface, to an outer surface of the flange portion; and a laminate comprising a reinforcing mesh and a basecoat layer covering the reinforcing mesh, the laminate covering the second lateral surface of the board profile portion, the inner and outer lateral surfaces of the supporting flange portion, the outer surface of the supporting flange portion, and portions of the base and outer surfaces of the board profile portion proximate the supporting flange portion, such that the first lateral surface of the board profile portion and portions of the base and outer surfaces of the board profile portion proximate the first lateral surface are not covered by the laminate.

2. The starter board of claim 1, wherein the reinforcing mesh comprises at least one of fiberglass, polyester, polypropylene, aramid, and carbon.

3. The starter board of claim 2, wherein the core member comprises at least one of expanded polystyrene ("EPS"), extruded polystyrene ("XPS"), polyisocyanurate, polyurethane, and foam glass.

4. The starter board of claim 2, wherein the basecoat layer comprises a Type N or S mortar modified and an acrylic polymer.

5. The starter board of claim 1, wherein the core member comprises at least one of expanded polystyrene ("EPS"), extruded polystyrene ("XPS"), polyisocyanurate, polyurethane, and foam glass.

6. The starter board of claim 5, wherein the basecoat layer comprises a Type N or S mortar modified and an acrylic polymer.

7. The starter board of claim 1, wherein the basecoat layer comprises a Type N or S mortar modified and an acrylic polymer.

8. A method of installing a wall cladding system, the method comprising:

providing a starter board comprising:

a core member defining a board profile portion including parallel, planar base and outer surfaces defining a uniform thickness, the base surface extending from a first lateral surface to a second lateral surface, and a supporting flange portion including inner and outer lateral surfaces extending outward from the planar outer surface, at the second lateral surface, to an outer surface of the flange portion; and a laminate comprising a reinforcing mesh and a basecoat layer covering the reinforcing mesh, the laminate covering the second lateral surface of the board profile portion, the inner and outer lateral surfaces of the supporting flange portion, the outer surface of the supporting flange portion, and portions of the base and outer surfaces of the board profile portion proximate the supporting flange portion, such that the first lateral surface of the board profile portion and portions of the base and outer surfaces of the board profile portion proximate the first lateral surface are not covered by the laminate;

securing the base surface of the starter board to a building substrate;

securing one or more insulation boards to the building substrate above the starter board, the one or more insulation boards having an outer surface defining a thickness that substantially matches the uniform thickness of the board profile portion of the starter board;

applying a mesh reinforced basecoat membrane to the outer surfaces of the starter board and the one or more insulation boards, with the basecoat membrane contacting and adhering to a basecoat layer of the starter board; and adhering a row of simulated bricks to the basecoat membrane with a lateral side of the simulated bricks being supported and aligned by the supporting flange.

9. A wall cladding system comprising:

a starter board comprising:

a core member defining a board profile portion including parallel, planar base and outer surfaces defining a uniform thickness, the base surface extending from a first lateral surface to a second lateral surface, and a supporting flange portion including inner and outer lateral surfaces extending outward from the planar outer surface, at the second lateral surface, to an outer surface of the flange portion; and a laminate comprising a reinforcing mesh and a basecoat layer covering the reinforcing mesh, the laminate covering the second lateral surface of the board profile portion, the inner and outer lateral surfaces of the supporting flange portion, the outer surface of the supporting flange portion, and portions of the base and outer surfaces of the board profile portion proximate the supporting flange portion, such that the first lateral surface of the board profile portion and portions of the base and outer surfaces of the board profile portion proximate the first lateral surface are not covered by the laminate;

a mesh reinforced basecoat membrane applied to the outer surface of the starter board, with the basecoat membrane contacting and adhering to a basecoat layer of the starter board; and a row of simulated bricks adhered to the basecoat membrane.

10. The wall cladding system of claim 9, wherein a lateral side of the simulated bricks is supported and aligned by the supporting flange.

* * * * *